United States Patent [19]

Amboss

[11] Patent Number: 4,656,393

[45] Date of Patent: Apr. 7, 1987

[54] METAL-TO-CERAMIC BUTT SEAL WITH IMPROVED MECHANICAL PROPERTIES

[75] Inventor: Kurt Amboss, Pacific Palisades, Calif.

[73] Assignee: Hughes Aircraft Company, Los Angeles, Calif.

[21] Appl. No.: 660,686

[22] Filed: Oct. 15, 1984

[51] Int. Cl.[4] ..... H01J 23/02

[52] U.S. Cl. ..... 315/5.38; 174/50.61; 174/50.63; 228/121; 228/175; 228/178

[58] Field of Search ..... 174/50.56, 50.61, 50.63; 228/121, 122, 123, 175, 176, 177, 178; 315/3.5, 5.38

[56] References Cited

U.S. PATENT DOCUMENTS

| | | | |
|---|---|---|---|
| 3,124,714 | 3/1964 | Bendorf | 174/50.63 X |
| 3,368,023 | 2/1968 | Dimock, Jr. | 228/122 |
| 3,368,104 | 2/1968 | McCullough | 315/5.38 |
| 3,646,670 | 3/1972 | Maeda et al. | 228/175 |
| 4,159,075 | 6/1979 | Ljung et al. | 228/121 |
| 4,281,941 | 8/1981 | Rottenkolber | 228/122 |
| 4,354,133 | 10/1982 | Vig | 174/50.63 |

*Primary Examiner*—Saxfield Chatmon

*Attorney, Agent, or Firm*—Paul M. Coble; A. W. Karambelas

[57] ABSTRACT

Seal (40) between travelling-wave tube electrodes (32 and 34) includes an inner hermetic seal ring (50) for providing vacuum sealing and an outer ring (52) which shares the mechanical stresses due to changes in temperature.

16 Claims, 5 Drawing Figures

METAL-TO-CERAMIC BUTT SEAL WITH IMPROVED MECHANICAL PROPERTIES

TECHNICAL FIELD

This invention is directed to a hermetic metal-to-ceramic seal particularly for electronic devices such as traveling-wave tubes wherein both hermetic sealing and mechanical strength must be maintained in a compact structure.

The metal-to-ceramic seals used in vacuum devices must have two properties. They must provide a vacuum barrier, and they must have considerable mechanical strength. Permanent seals are made by a combination of brazes and welds. The brazing is performed at a temperature up to about 1,000° C. At such a temperature, the brazed material becomes liquified and alloyed with interface coatings on the ceramic and on the metal. When the seal is to be between copper and a ceramic such as alumina, a problem arises because the two materials have very different coefficients of expansion. The difference is about 0.012 inch per inch of material at a temperature change of 1,000° C. A braze made with such dissimilar materials without special design care will, upon cooling, lead to a highly stressed ceramic which will crack as a result of the stress.

The problem is commonly overcome by using a multiple flange structure of a material having an intermediate thermal coefficient of expansion, such as Kovar. This divides the strain between several locations, and the Kovar flanges are designed to take up the strain. However, when such a structure is applied to an electronic device such as a traveling-wave tube, the spacing between the electrodes is considerably larger than the spacing required to prevent voltage breakdown. When such seals are used between multistage depressed electron collectors in traveling-wave tubes, the additional space taken up by the Kovar flange seals imposes additional design problems since the heat flow through the Kovar is small compared to the heat flow through the copper collectors.

Thus, there is need for a metal-to-ceramic butt seal with proper vacuum sealing capabilities, sufficient mechanical strength, compact arrangement, and good thermal conductivity properties.

SUMMARY OF THE INVENTION

In order to aid in the understanding of this invention, it can be stated in essentially summary form that it is directed to a butt seal between metal and ceramic parts where the parts are subject to differential strain with change in temperature. The butt seal comprises a first seal member joined to the metal part and brazed to the ceramic part to provide a hermetic seal therebetween and at least a second seal member joined to the metal part and brazed to the ceramic part for sharing the mechanical load resulting from thermal strain.

It is, thus, a purpose and advantage of this invention to provide a metal-to-ceramic butt seal wherein a first seal member provides hermetic sealing directly between a metal part and a ceramic part and one or more additional seal members which carry a substantial portion of the mechanical load resulting from differential thermal expansion.

It is another purpose and advantage of this invention to provide a metal-to-ceramic butt seal with improved mechanical properties which is compact so that it does not introduce more space into the structure than is required by other properties, and is capable of maximizing heat transfer so as to improve the thermal properties of the structure in which the seal is an integral part.

Other purposes and advantages of this invention will become apparent from a study of the following portions of the specification, the claims and the attached drawings.

DESCRIPTION OF THE PREFERRED EMBODIMENT

Figure 1:
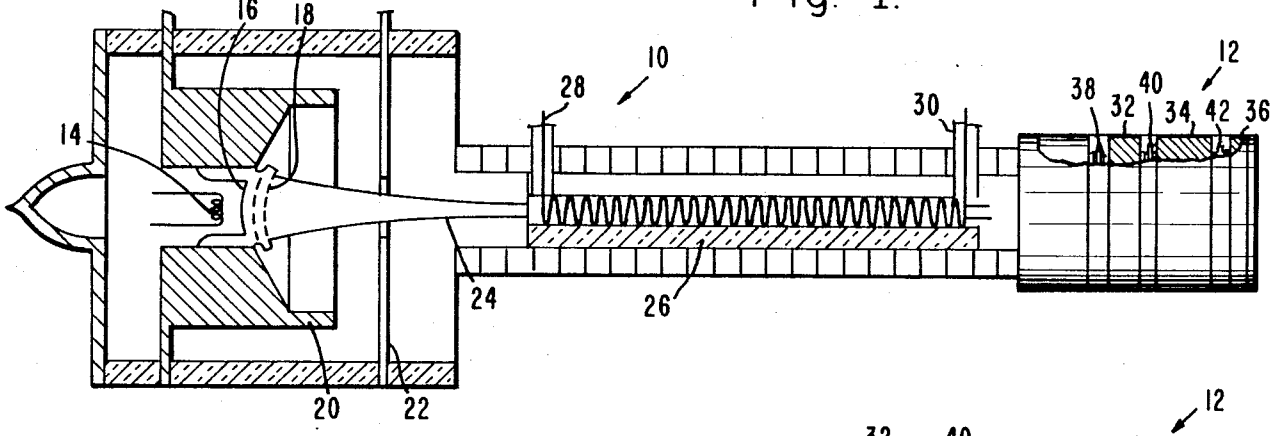
FIG. 1 is a central longitudinal section through a traveling-wave tube, shown schematically, which serves as an example of an electrical device in which the metal-to-ceramic butt seal of this invention can be employed.

Traveling-wave tube 10 is a particularly useful application of the metal-to-ceramic butt seal of this invention because the traveling-wave tube has a collector 12 which has several metal parts which require significant thermal throughput, which must be electrically isolated, which provide a sealed enclosure and which must be mechanically strong. In order to understand the application requirements of the seal, the traveling-wave tube 10 is generally described. Heater 14 heats cathode 16 which gives off electrons which are controlled by grids 18. Focus electrode 20 focuses the electrons into a beam 24 while anode 22 accelerates the beam 24 which passes through the slow-wave structure 26 of the tube. A radio frequency signal coupled into the slow-wave structure 26 at coupling 28 interacts with the beam 24 in the slow-wave structure 26 to produce radio frequency power out at coupling 30. The spent electron beam out of the slow-wave structure 26 is collected in collector 12. The collector 12 collects the electrons as they emerge from the slow-wave structure 26 and dissipates the electrons in the form of heat. This is accomplished by thermal conduction to the colder outside surface through the electrodes of the collector 12.

Figure 2:
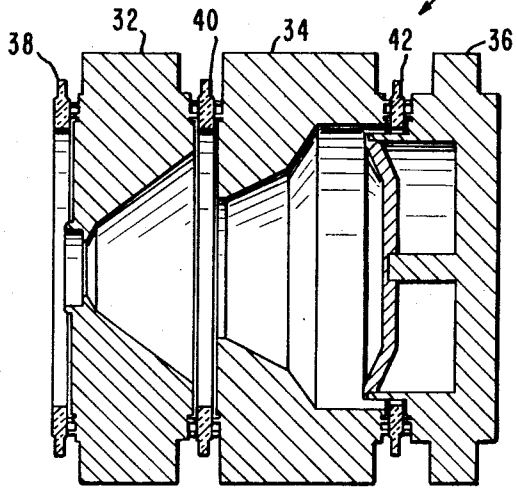
FIG. 2 is an enlarged longitudinal section through the multistage depressed electron collector in the traveling-wave tube of FIG. 1, showing the manner in which the butt seals of this invention are employed between the collector stages, with a double butt seal being illustrated.

Collector electrodes 32, 34 and 36 are shown in FIGS. 1 and 2. They are electrically isolated from each other and secured to each other and to the housing of the slow-wave structure 26 by means of seals 38, 40 and 42. The electrodes 32 and 34 are annular structures, while the electrode 36 is an end cap. A plurality of collector electrodes is provided so that the different electrodes can be made progressively more negative with respect to the slow-wave structure to effectively sort the electron velocities in accordance with their energy.

The multiple-electrode depressed collector improves efficiency in collection and, thus, reduces the amount of heat which must be dissipated. Considering the body of the traveling-wave tube to be at zero voltage, electrode 32 is at a low negative potential, electrode 34 is at a lower negative potential, and electrode 36 is at a still lower negative potential which may be cathode potential. For these reasons, the seals 38, 40 and 42 must be electrically isolating. In addition, since the entire system is evacuated, the seals 38, 40 and 42 must provide hermetic sealing.

It will be appreciated that the traveling-wave tube is a specific example of an electron device in which the seal of this invention is particularly useful. It is also useful in other electrical devices and mechanical devices which require mechanically strong hermetic seals between metal and ceramic parts.

Figure 3:
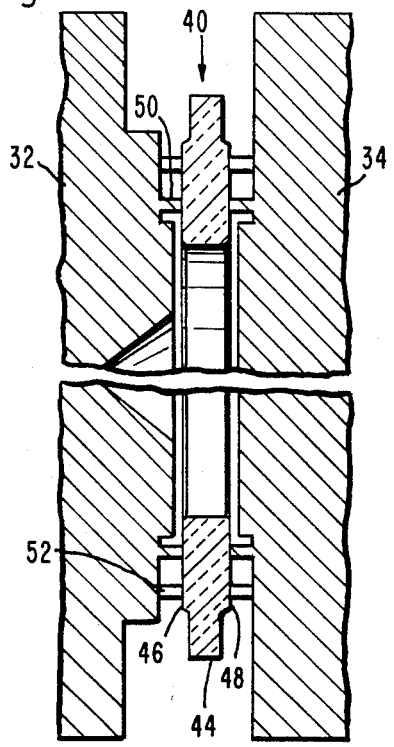
FIG. 3 is an enlarged section through one of the seal structures shown in FIG. 2, with parts broken away.
Figure 4:
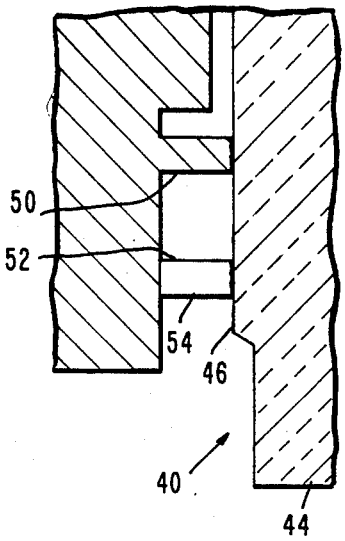
FIG. 4 is a further enlarged section of a portion of the lower part of FIG. 3 showing the seal of this invention.
Figure 5:
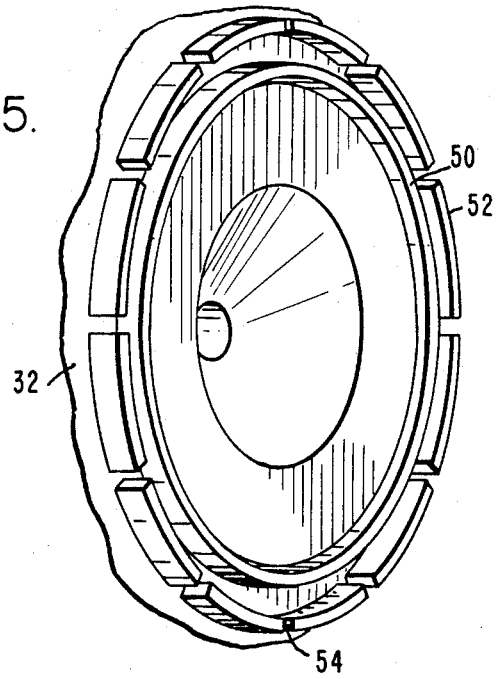
FIG. 5 is a perspective of one example of the metal portion of the seal before it is attached.

FIGS. 3, 4 and 5 show the seal structure in detail wherein the example incorporates two seal members. The seal 40 is shown, and the other seals are identical. Ceramic ring 44 is positioned between the electrodes 32 and 34. It is appreciated that the electrodes 32 and 34 are of copper or of a high copper alloy for electrical purposes and for thermal conductivity purposes. Ceramic ring 44 is sufficiently thick in the distance between the electrodes to provide the necessary voltage separation. The ceramic ring 44 has flat surfaces 46 and 48 which are preferably planar, parallel to each other and are treated to alloy with braze material. First seal member 50 is an annular ring formed integrally with electrode 32. While integral formation is preferred, with the ring being machined out of the body metal of the electrode, the ring may be attached by welding or the like if other requirements permit such attachment. The first seal member 50 is a continuous ring which, when hermetically secured to the surface 46 of ceramic ring 44, provides hermetic sealing.

Attachment of the first seal member 50 to the surface 46 is by brazing. A suitable braze material which alloys both with the material on the surface 48 and with the ring is employed. During brazing, the temperature is raised to about 1,000° C. depending on the braze material, which results in a greater expansion of electrode 32 in the diametrical direction than the ring 44. Thus, upon cooling, the first seal member 50 bends in the form of a fixed end beam subject to shear. This thermal contraction causes the left end of the beam to go up relative to the right end as it is oriented in FIG. 4.

Second seal member 52 in the form of a ring is provided to accept some of the stress resulting from the differential thermal contraction which results from cooling down after brazing. The second seal ring 52 is the same as the first seal ring 50 in that it is preferably integrally formed with electrode 32 and is brazed to surface 46. The rings may be the same in cross-section, but the ring 52 has at least one opening therein to permit the space between the rings to achieve outside ambient pressure. A plurality of slots are shown in FIG. 5, with the slot 54 at the bottom also shown in FIG. 4. The number of seal member rings is at least two but may be more. All seal member rings after the first are slotted to permit venting to the outside of inter-ring spaces. The number of rings is selected as a function of space, strength requirements, differential thermal contraction and properties of the metal such as ductility and strength. In the exemplary embodiment illustrated, there are the two seal member rings 50 and 52. The spacing between the rings is determined by the stress field around each of the braze joints in the ceramic and is chosen so that the stresses do not overlap to an appreciable extent. The height and thickness of each ring is established as a function of material properties. An additional number of second seal rings can be concentrically fashioned around seal ring 52 if more mechanical strength addition is helpful to the joint. The entire collector is assembled into the arrangement shown in FIG. 2, together with the next member to the left of seal 38, and the entire assembly is brazed. At this time, the joint is brazed between the seal members and the facing ceramic rings. In modern terminology, brazing materials include a large number of copper and non-copper alloys. In this way, the metal-to-ceramic butt seal with improved mechanical properties is created. When stresses are applied to the finished assembly, the stresses are shared by the seal rings, to eliminate cracking.

This invention has been described in its presently contemplated best mode, but it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A seal comprising:

a ceramic insulator having a surface;

a metal electrode;

a first seal member and at least one protruding abutment forming a second seal member, said first seal member protruding outward from said metal electrode and contacting said surface of said ceramic insulator and being hermetically sealed to both said electrode and said ceramic insulator, and each said protruding abutment being disposed radially outward from said first seal member, protruding outward from saaid metal electrode and contacting said surface of said ceramic insulator and being attached to said metal electrode and brazed to said ceramic insulator, each said protruding abutment being positioned with respect to said first seal member so as to divide stress loads therebetween.

2. The seal of claim 1 wherein said first seal member is in the shape of a continuous ring and said protruding abutment is in the shape of a discontinuous ring concentric to said first seal member and having at least one opening therein.

3. The seal of claim 1 wherein said first seal member and said protruding abutment are integrally formed with said metal electrode.

4. The seal of claim 3 wherein each said protruding abutment forming said second seal member is positioned radially outside said first seal member.

5. The seal of claim 4 wherein said metal electrode is a copper-containing metal electrode.

6. The seal of claim 4 wherein said electrode is a collector electrode in a traveling-wave tube.

7. The seal of claim 6 wherein said metal electrode is a copper-containing metal electrode.

8. The seal of claim 1 wherein said electrode is in a hermetically sealed electronic device.

9. A seal comprising:

a metal electrode having a face;

first and second seal members secured to and protruding outwardly from said face, said second seal member being positioned adjacent to and radially outward from said first seal member, said seal members terminating in a plane away from said face;

a ceramic insulator member having a flat surface thereon, said first and second seal members both lying adjacent to and contacting said flat surface of said insulator member and being brazed thereto so as to form a seal between said electrode and said insulator member with said seal members sharing the mechanical stresses between said electrode and said ceramic member.

10. The seal of claim 9 wherein each of said seal members is a seal ring with said second seal ring embracing said first seal ring.

11. The seal of claim 10 wherein said second seal ring is discontinuous to permit communication from the space between said seal rings to the exterior.

12. The seal of claim 10 wherein the length of said seal members between said face of said electrode and said surface on said insulator member is sufficiently long so that stresses are insufficient to cause cracking of said ceramic member in temperature ranges from 1,000° C. to 0° C. and wherein said seal members share the mechanical stress due to those temperature changes.

13. The seal of claim 9 wherein the length of said seal members between said face of said electrode and said surface on said insulator member is sufficiently long so that stresses are insufficient to cause cracking of said ceramic member in temperature ranges from 1,000° C. to 0° C. and wherein said seal members share the mechanical stress due to those temperature changes.

14. The seal of claim 12 wherein said electrode is an electrode in the collector of a traveling-wave tube and said insulator member separates said electrode from the adjacent traveling-wave tube structure.

15. The seal of claim 14 wherein there is a plurality of said seals in said collector of said traveling-wave tube.

16. The seal of claim 9 wherein said first and second seal members are formed integrally with said metal electrode.

* * * * *